United States Patent [19]

Hopkins et al.

[11] Patent Number: 4,803,880

[45] Date of Patent: Feb. 14, 1989

[54] HOLLOW ARTICLE FORGING PROCESS

[75] Inventors: Steven M. Hopkins, North Palm Beach; William G. Askey, Jupiter, both of Fla.

[73] Assignee: United Technologies Corporation, Hartford, Conn.

[21] Appl. No.: 135,769

[22] Filed: Dec. 21, 1987

[51] Int. Cl.[4] ..... B21C 23/00; B21D 37/02

[52] U.S. Cl. ..... 72/354; 72/356; 72/256; 72/264; 72/700

[58] Field of Search ..... 72/352–354, 72/356, 358, 359, 38, 700, 264, 256, 267, 342; 148/11.5 F, 12.7 N

[56] References Cited

U.S. PATENT DOCUMENTS

| | | | |
|---|---|---|---|
| 942,989 | 12/1909 | Warren | 72/256 |
| 1,216,282 | 2/1917 | Carver et al. | 72/267 |
| 2,679,931 | 6/1954 | Cigliano | 72/267 |
| 2,932,889 | 4/1960 | Kritscher | 29/542 |
| 2,966,987 | 1/1961 | Kaul . | |
| 3,080,650 | 3/1963 | Jury | 29/534 |
| 3,443,411 | 5/1969 | Anthony | 72/267 |
| 3,449,936 | 6/1969 | Woodle | 72/254 |
| 3,519,503 | 7/1970 | Moore et al. | 148/11.5 F |
| 3,610,015 | 10/1971 | Bollmann et al. | 72/264 |
| 3,698,219 | 10/1972 | Moore et al. | 72/361 |
| 3,780,553 | 12/1973 | Athey | 72/342 |
| 4,166,373 | 9/1979 | Braun | 72/356 |
| 4,208,900 | 6/1980 | Zawacki et al. | 72/354 |
| 4,252,011 | 2/1981 | MacNitt, Jr. et al. | 72/354 |
| 4,265,105 | 5/1981 | MacNitt, Jr. et al. | 72/354 |
| 4,312,211 | 1/1982 | MacNitt, Jr. et al. | 72/354 |
| 4,382,324 | 5/1983 | Halene | 29/168 |
| 4,474,044 | 10/1984 | Leistner et al. | 72/700 |

FOREIGN PATENT DOCUMENTS

| | | | |
|---|---|---|---|
| 421150 | 2/1911 | France | 72/356 |
| 368312 | 2/1939 | Italy | 72/264 |
| 570954 | 7/1945 | United Kingdom | 72/264 |

*Primary Examiner*—Lowell A. Larson

*Attorney, Agent, or Firm*—Charles E. Sohl

[57] ABSTRACT

A process for forging hollow elongated articles from superalloys and titanium alloys. The process employs preconditioned material which has low strength and high ductility. The process is performed in a forging press and has an initial step which converts a preform into a intermediate shape by press motion which produces radial outward workpiece flow. Press punch geometry is then changed and the operation continues with radial inward flow about a mandrel.

4 Claims, 1 Drawing Sheet

HOLLOW ARTICLE FORGING PROCESS

DESCRIPTION

TECHNICAL FIELD

This invention relates to the forging of hollow articles of high strength materials such as superalloys and titanium alloys. This invention also relates to a multistep forging process and apparatus, for producing hollow articles, which is performed using an adaptable die arrangement in which the workpiece is not removed from the press during the multistep operations.

BACKGROUND ART

Gas turbine engines contain a large variety of hollow structures. The temperatures and stresses under which most gas turbine engine components operate necessitates the fabrication of such structures from high strength, high temperature material, such as superalloys and titanium alloys. The use temperatures and stresses also require that the materials be processed by hot working rather than by casting. These materials are exceedingly difficult to and costly to machine and consequently forging processes which can produce useful, near net, shapes are highly desired.

U. S. Pat. No. 3,519,503 describes a forging process applicable to superalloys and titanium alloys, but does not disclose specific forging geometries to achieve specialized shapes. The contents of this U.S. Patent are incorporated herein by reference. Related U.S. Pat. Nos. 3,698,219, 4,265,105 and 4,312,211 are also incorporated herein by reference.

There are many hollow, symmetrically radial turbine engine components such as shafts which cannot now be forged efficiently.

Accordingly, it is an object of the invention to describe a forging process for producing hollow articles such as shafts from superalloys and titanium alloys. It is another object of the invention to describe a process for producing such hollow articles using a specific press and die arrangement without the necessity to remove the workpiece from the press between steps.

DISCLOSURE OF INVENTION

The invention process starts with material which has been preconditioned to give it low strength and high ductility. Such preconditioning is described in U.S. Pat. No. 3,519,503 and consists, in a preferred form, of extruding a compacted powder billet through a die to produce a reduction in area of at least about 4:1 and preferably at least about 6:1 at a temperature below but within about 450° F. of the normal recrystallization temperature of the material. Such processing produces an exceedingly fine grain size in the material, an average grain size will be about 35 microns. Such preconditioned material, when forged below but within about 350° F. of the material recrystallization temperature exhibits properties of low stress and high ductility.

Alternatively, starting powders of approximately this fineness (minus 270 US standard sieve and finer) can be placed in a sealed container and hot isostatically pressed at temperatures below the material recrystallization temperature to produce a fine grain starting material, having the requisite high ductility and low strength starting material. Finally, the extrusion process may be adapted to use with cast starting materials using for example the teachings of U.S. Pat. Nos. 4,574,015 and 4,579,602.

Exemplary materials to which the invention can be applied are described in Table 1 which list nominal compositions. Table 2 lists approximate recrystallization temperatures for these materials.

The starting material is provided in the form of a billet 10 which is generally cylindrical. This billet is processed using a punch 20 and die 30 arrangement illustrated in FIG. 1. The punch is shown as having a moveable slide portion 22 which moves within hollow cavity 26 within the punch 20. The slide 22 can be positioned to be flush with the punch face 24 and can be locked in this position to provide the same forging action as a flat face die. Alternately the slide can be withdrawn into the die providing a punch with a hollow central cavity. The die has a centrally located mandrel 32, and the mandrel diameter is less than the punch cavity diameter. The mandrel diameter defines the internal diameter of the final product and the punch cavity diameter defines its outer diameter.

The process is an unusual one in that multiple forming operations which involve reversed metal flow are accomplished in a single press operation with no changes in the punch and die except the movement of the slide.

Starting in FIG. 1 the billet 10 is shown between the punch 20 and die 30 with the slide 22 in its fully extended positions so that the punch has a flat work face 24. When the punch 20 is forced down into the die, the low strength high ductility billet workpiece 10 flows radially outward as shown by arrows A, into the die 30 forming an intermediate product 40, as shown in FIG. 2, consisting of a disk having a reduced thickness center portion 42 with the reduced thickness being defined by the gap between the mandrel 32 face and the slide 24 face.

Next, as shown in FIG. 3, the slide 22 is unlocked and withdrawn into the punch 20 (or alternately allowed to move freely) and the (now hollow) punch 20 is forced into the die. The intermediate product 40 is forced inwardly as shown by arrows B and flows around the mandrel 32 and then upwards. The mandrel 32 defines a hollow cavity within the workpiece. The final product is a hollow cylinder, its external dimension being equal to the diameter of the cavity 26 within the punch 20, and its internal dimension being equal to that of the mandrel 32 and having a thin web of metal closing off one end.

Because of the nature of the materials involved, which must be worked at high temperature and which even thought having reduced strength and increased ductility must still be worked using high forces, the only practical die materials known are molybdenum based material such as TZM molybdenum. Such molybdenum based materials are exceedingly susceptible to oxidation, consequently, the forging operation must be performed under high vacuum conditions or an inert or protective atmosphere. Further, the high forces involved necessitates a lubricant between the workpiece and the punch and die to prevent galling and binding of the workpiece to the punch and die. An appropriate lubricant is boron nitride which can be applied by spraying an aqueous boron nitride suspension onto the die punch and workpiece Further details are set out in U.S. Pat. No. 3,780,553 which is incorporated herein by reference.

The foregoing and other features and advantages of the present invention will become more apparent from the following description and accompanying drawings.

BEST MODE FOR CARRYING OUT THE INVENTION

Figure 1:
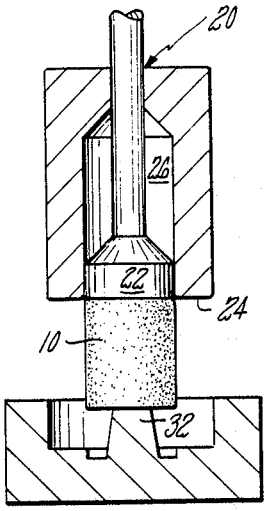
FIG. 1 shows the billet between the punch assembly and the die with the slideable punch portion extended to provide a flat punch face.
Figure 2:
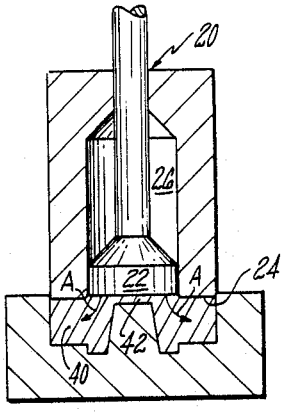
FIG. 2 shows the punch, die and workpiece at the end of the first forging operation illustrating the intermediate workpiece.
Figure 3:
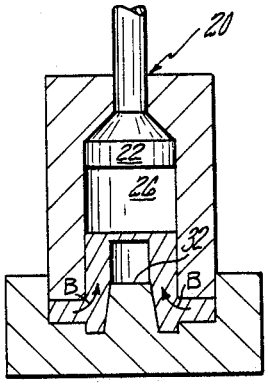
FIG. 3 shows the second forging step.
Figure 4:
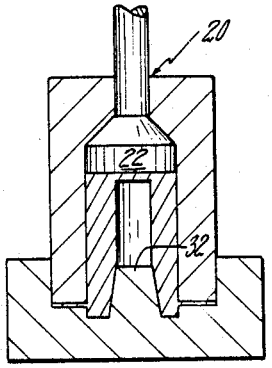
FIG. 4 shows the apparatus and workpiece at the conclusion of the invention process.

A superplastic workpiece of IN100 is provided in the form of a cylindrical billet having a height of 6 inches, and a diameter of 4 inches. The billet is placed into a TZM molybdenum die having a six inch diameter by eight inch deep recess which contains a central protruding mandrel 2 inches in diameter by two inches high. A six inch diameter TZM molybdenum punch is provided and adapted to be moved into the die recess. The punch contains a four inch diameter central slidable portion which can be locked to give the punch effectively a flat face geometry or can be withdrawn to provide a hollow 4 inch diameter cavity within the punch. The workpiece, punch and die are heated to 1900° F.–2000° F. and heating and forging are performed in a vacuum.

The slide is located to provide a flat face punch geometry and the punch forced down onto the workpiece causing the workpiece to flow outwardly around the mandrel and into the die. The slide is then withdrawn and the punch is forced further into the die forcing the material to flow inwardly back up into the cavity within the punch. The resultant product is a cylinder having a two inch inside diameter, a four inch outside diameter and a 1.0 inch wall thickness and a height of six inches.

Although this invention has been shown and described with respect to detailed embodiments thereof, it will be understood by those skilled in the art that various changes in form and detail thereof may be made without departing from the spirit and scope of the claimed invention.

TABLE 1

IN100: 10% Cr, 15% Co, 4.5% Ti, 5.5% Al, 3% Mo, 0.17% C, 0.75% V, 0.015% B, 0.05% Zr, Bal Ni.

Waspaloy 19.5% Cr, 13.5%Co. 0.07% C, 3.5% Ti, 1.4% Al, 4% Mo, 0.005% B, 0.08% Zr, Bal N.

Astroloy: 15.5% Cr, 17% Co, 0.07% C, 3.5% Ti, 4.0% Al, 5.0% Mo, 0.025% B, Bal Ni.

Ti 8-1-1: 7.9% Al, 1.0% Mo, 1.0% V, Bal Ti.

Ti 6-4: 6.0% Al, 4.0% V

TABLE 2

Recrystallization Temperature, °F.

IN100: 2100
Waspaloy: 1850
Astroloy: 2050
Ti 8-1-1: 1600
Ti 6-4: 1400

We claim:

1. An apparatus for producing hollow articles from superalloys and titanium alloys which includes:

a. a die assembly having a recess and containing a protruding mandrel within said recess;

b. a punch assembly which includes a punch shaped to fit into the die recess, said punch having a hollow cavity which contains a movable slide, means to releasably fix said slide with the punch to present a flat face essentially parallel to the die recess;

c. means to urge the punch, including the slide, and die assembly together;

d. means to permit said slide within said punch to move away from said mandrel to allow the alloy to flow within the hollow cavity.

e. means to heat the punch assembly and die assembly to an elevated temperature;

f. means to protect the punch assembly and die assembly from oxidation.

2. A method for producing hollow articles from superalloys and titanium alloys which have been preconditioned to establish a low strength high ductility condition including the steps of:

a. forging a workpiece between a flat face punch and a matching recessed die having a projecting die mandrel to cause outward radial flow of the workpiece to form an intermediate article;

b. converting the flat face punch into a hollow punch; and c. forging the intermediate article using the hollow punch to cause radial flow inwards and upwards around the die mandrel and into the hollow punch; whereby a hollow forged article results.

3. A method as in claim 2 wherein said intermediate article has a central portion of reduced thickness.

4. A method as in claim 2 wherein step a and step c are performed in the same apparatus.

* * * * *